United States Patent [19]

Burton

[11] Patent Number: 5,058,889

[45] Date of Patent: Oct. 22, 1991

[54] MOLDED FIBERGLASS PITCHER'S PORTABLE INDOOR/OUTDOOR MOUND, AND METHODS OF CONSTRUCTING AND UTILIZING SAME

[76] Inventor: Frank I. Burton, 6872 N. Park La., Shreveport, La. 71107

[21] Appl. No.: 674,979

[22] Filed: Mar. 26, 1991

[51] Int. Cl.[5] ..... A63B 71/00

[52] U.S. Cl. ..... 273/25

[58] Field of Search ..... 273/25

[56] References Cited

U.S. PATENT DOCUMENTS

| | | | |
|---|---|---|---|
| D. 214,743 | 7/1969 | Goeders | 273/25 |
| D. 258,903 | 4/1981 | Goeders . | |
| 2,156,469 | 5/1939 | Boltz | 273/25 |
| 2,189,428 | 2/1940 | Love | 273/25 |
| 3,236,520 | 2/1966 | Friedman . | |
| 3,499,028 | 11/1969 | Goeders | 273/25 |
| 3,703,285 | 11/1972 | Hollaway | 273/25 |
| 3,837,646 | 9/1974 | Goeders | 273/25 |
| 4,057,248 | 11/1977 | Stoecker . | |
| 4,063,729 | 12/1977 | Hollaway | 273/25 |
| 4,561,653 | 12/1985 | Wright | 273/25 |
| 4,666,155 | 5/1987 | Stille | 273/25 |
| 4,749,223 | 6/1988 | Goeders | 273/25 |
| 4,925,186 | 5/1990 | Stevenson | 273/25 |

OTHER PUBLICATIONS

Official Gazette Oct. 3, 1989.
Design Patent 303,823.

*Primary Examiner*—Theatrice Brown
*Attorney, Agent, or Firm*—Irving M. Weiner; Robert M. Petrik; Joseph P. Carrier

[57] ABSTRACT

A portable pitching mound assembly including a mound body and home plate attachment. The mound body includes depressions adjacent the pitching rubber and on the forward slope of the mound. These depressions are filled with soil to simulate field conditions. The mound body may be provided in several interlocking sections to provide easy movement of the assembly for indoor or outdoor use. The upper surface of the mound body includes an abrasive surface for non-skid footing.

18 Claims, 2 Drawing Sheets

MOLDED FIBERGLASS PITCHER'S PORTABLE INDOOR/OUTDOOR MOUND, AND METHODS OF CONSTRUCTING AND UTILIZING SAME

BACKGROUND OF THE INVENTION

1. Field of the Invention

The present invention relates generally to training equipment for baseball pitchers. More particularly, the present invention relates to an artificial, portable pitcher's mound for use indoors or outdoors including a "life-like" pitching area to simulate actual field conditions. The mound may also include markings to aid in instructing the user with respect to proper stride and foot location.

When practicing and warming-up for pitching, it is important for the player to be able to simulate the conditions normally faced in game situations. This permits the player to be "comfortable" when the game situation is forthcoming.

In many areas, inclement weather prevents actual field practice. Sometimes, it is possible to practice indoors, but this is generally not conducive to effective pitching practice since the regulation height mound is not available. In addition, many locations do not have a "regulation bull pen" mound for the pitchers to warm-up before entering a game.

The present invention solves each of the above-mentioned difficulties by providing an easily portable, game simulating pitcher's mound.

2. Description of the Relevant Art

Heretofore, it has been known to provide portable pitching mounds. Many attempts have been made to provide a training device for pitchers.

U.S. Pat. No. 3,236,520 issued in 1966 discloses a portable mound of fiberglass or other plastic and of regulation dimensions. A non-stick rubber or plastic coating is provided where the pitcher would step or stride. This mound does not accurately simulate a real pitcher's mound since the hard plastic would not provide a field simulating push-off and stride. In addition, this mound would not accurately simulate the effect of having a natural surface for the stride foot to land in.

U.S. Pat. No. 3,479,028 issued in 1969 discloses a portable pitching mound made of fiberglass and including a depression to provide a pitching station. This mound fails to simulate game conditions for the reasons discussed above. In addition, the mound can not be used indoors since it must be secured by anchor bolts.

U.S. Pat. No. 3,837,646 issued in 1974 discloses a portable pitching mound having a toe hole formed in the upper surface. The hole is filled with sponge rubber. This arrangement still does not provide a life-like training device.

U.S. Pat. No. 4,057,248 issued in 1977 discloses a pair of ground engaging panels for simulating the regulation pitching distance. However, this arrangement fails to provide a regulation height pitcher's mound for real-life simulation.

U.S. Pat. No. 4,561,653 issued in 1985 discloses a fiberglass shell member including a depression at the forward end. However, the shape of the mound is provided for pitching softballs and thus has a flatter surface sloping downwardly from the rubber towards home plate. The depression is not intended to accommodate sand or other material.

U.S. Des. Pat. No. 258,903 discloses a portable pitching mound similar to the softball mound discussed above. And U.S. Des. Pat. No. 303,823 discloses a portable mound which does not appear to include depressions.

The present invention includes a portable pitcher's mound usable indoors or outdoors which effectively simulates on-field conditions.

SUMMARY OF THE INVENTION

The present invention provides a pitcher's mound and home plate which meets the regulations for various levels of play, including the mound height and the distance to home plate. In addition, the mound can be provided in sections which are locked together for easy transportation. The generally convex-shaped, circular mound includes depressions adapted to contain sand or other clay-like material to provide a user with a realistic footing at the "rubber" or pitching plate and the landing area or stride area. The mound may also be used practice various defensive skills, such as "pick-off" plays. A home plate can be provided attached to the mound by a calibrated line to permit the mound and plate to be set at the regulation distance (60 feet 6 inches, 54 feet, 46 feet) quickly and efficiently.

The fiberglass pitcher's mound of the present invention would include a non-skid surface and would also permit markings to be provided on the surface to aid in training and proper foot positioning and stride length, needed by all skill levels.

It is an object of the present invention to provide a portable pitcher's mound adaptable to indoor or outdoor use.

It is a further object of the present invention to provide a pitcher's mound that meets all baseball regulations.

It is a further object of the present invention to provide a means for instructing the pitcher with respect to proper foot location and stride length which may effect the pitch location.

Still another object of the present invention is to provide a portable pitcher's mound which closely simulates the footing condition on the regulation playing field.

The above and further objects of, details and advantages of the invention will become apparent from the following detailed description when read in conjunction with the accompanying drawings.

DETAILED DESCRIPTION OF THE PREFERRED EMBODIMENTS

Figure 1:
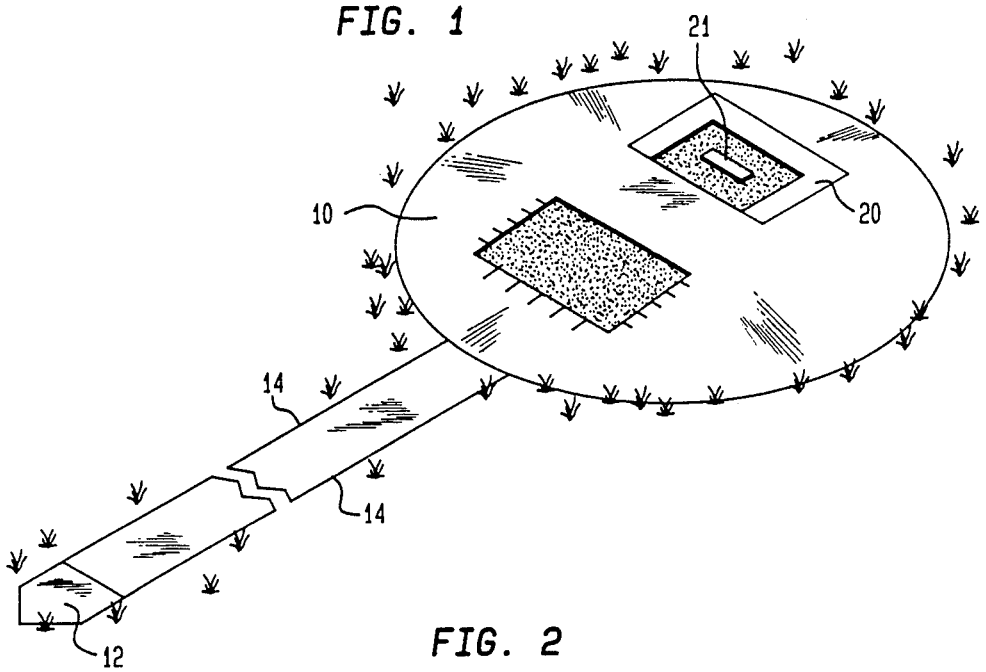
FIG. 1 illustrates a perspective view of the pitcher's mound in accordance with the present invention.

With reference to FIG. 1, there is shown a portable, substantially circular pitcher's mound body 10 of generally convex shape and an attached home plate 12 in accordance with the present invention. Plate 12 is adjustably attached to mound body 10 by calibrated lines 14 which permit home plate 12 to be set at regulation distances. Typically, these distances are 60 feet 6 inches, 54 feet and 46 feet depending upon the skill level and/or age of the players involved.

Figure 2:
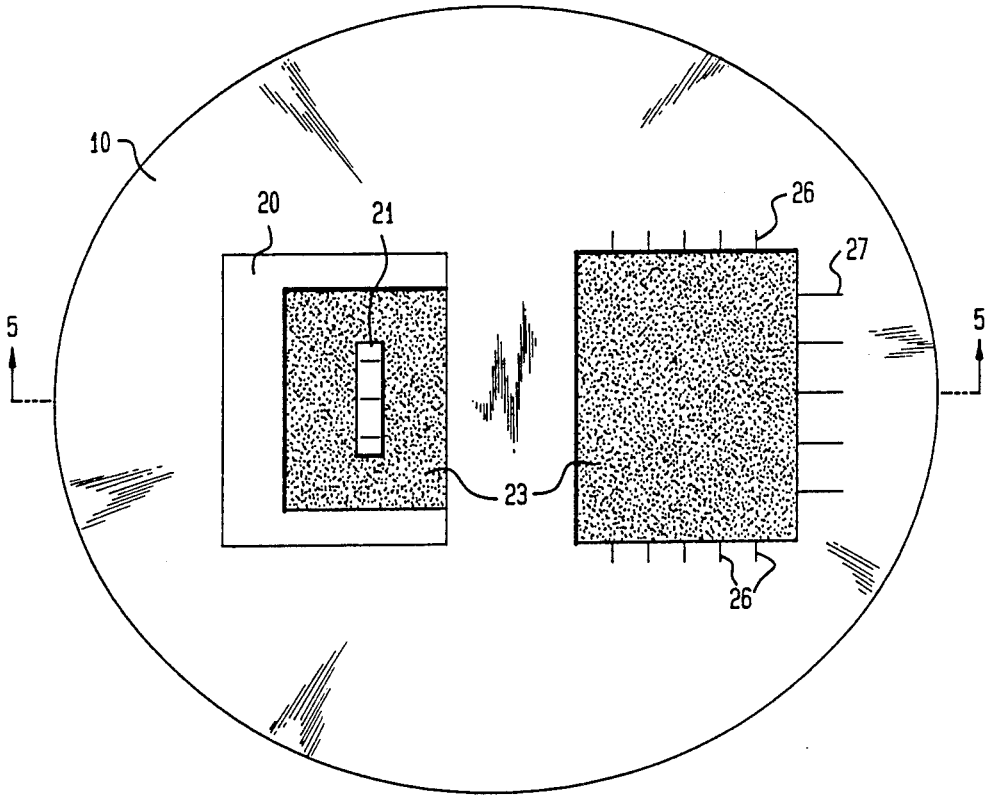
FIG. 2 illustrates a top view of the pitcher's mound in accordance with the present invention.
Figure 3:
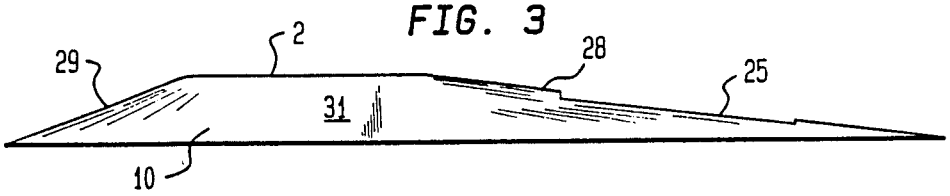
FIG. 3 illustrates a side view of the pitcher's mound in accordance with the present invention.

As best seen in FIG. 2, the mound 10 comprises a circular member whose diameter may vary according to the baseball regulations for each skill level. The height of the mound may also differ according to the skill level. Preferably, the mound body 10 is constructed of fiberglass in several interlocking sections for easy transportation (note FIG. 4). The upper surface may include a non-skid abrasive surface to provide proper footing.

Mound body 10 includes a level area 20 at the highest portion of the mound that surrounds the "rubber" 21. Directly attached and surrounding the rubber 21 is a first depression 22 including four sides and a bottom adapted to hold a soil-like material 23 which will closely simulate the actual field conditions. Material 23 preferably comprises sand but may comprise soil taken from the playing field. Depression 22 permits the user to adjust the mound to meet any personal preferences the user may have. In addition, the rubber 21 has thereon markings to provide a means for the user to instantaneously place the corresponding foot in the proper location. Finally, depression 22 permits the user to wear cleats while practicing either indoors or outdoors.

A corresponding or second depression 25 provides a landing portion for the pitcher's feet after completion of the pitch delivery. Again, depression 25 including a bottom and four sides, and accommodates a material 23 sloped to provide simulated field conditions. Located adjacent depression 25 are markings 26,27 to provide a means for checking a pitcher's stride length and foot location upon completion of a pitch delivery. Marks 26 permit the user to check the stride length and marks 27 permit the user to check the foot location.

Second depression 25 is located on the forward sloped area 28. Generally, mound 10 slopes downwardly a rate of one inch for every one foot from level area 20, including a rear slope 29 and first and second side slopes 30, 31.

Figure 4:
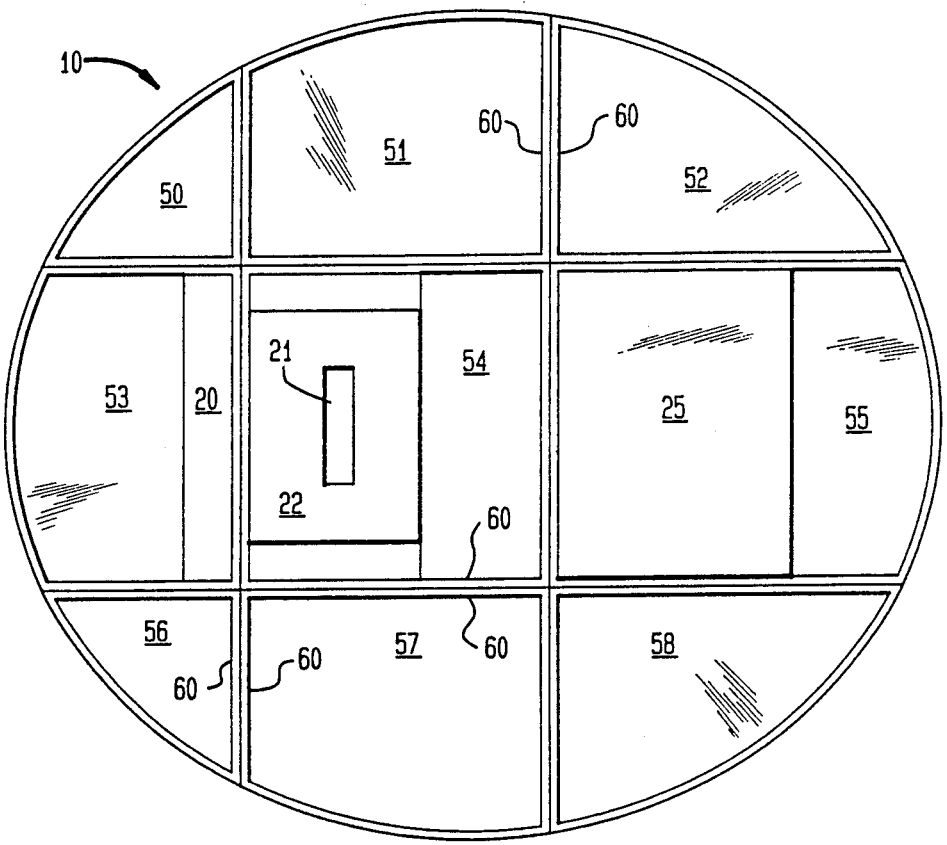
FIG. 4 illustrates a bottom view of the pitcher's mound in accordance with the present invention.
Figure 5:
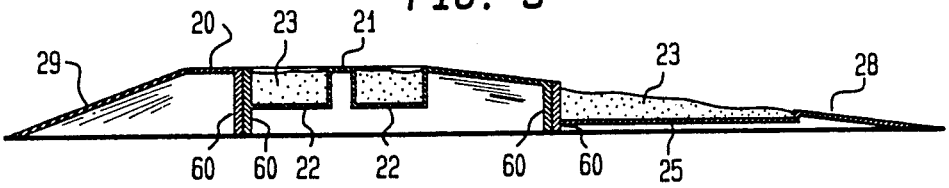
FIG. 5 illustrates a cross-section taken along line 5—5 in FIG. 2 in accordance with the present invention.
Figure 6:
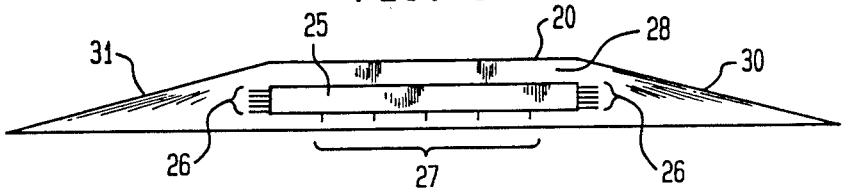
FIG. 6 illustrates a front view of the pitcher's mound in accordance with the present invention.

As best seen if FIG. 4, the mound body 10 may be provided in several sections 50, 51, 52, 53, 54, 55, 56, 57, 58 for easy transportation. Each section 50–58 includes interlocking wall members 60 (best seen in FIG. 5). The wall member 60 may be fastened together by any well known method.

In addition to being usable indoors or outdoors, the pitcher's mound in accordance with the present invention is maintenance free and durable. The mound may be used indoors or outdoors for teaching, training, practice or "bullpen" purposes.

Although there has been described what is at present considered to be preferred embodiments of the invention, it will be understood that various modifications and variations may be made therein, and it is intended to cover in the appended claims all such modifications as fall within the true spirit and scope of the invention.

I claim:

1. A portable pitcher's mound assembly, comprising;

a generally circular, convex-shaped mound body to be supported on a playfield surface, said body having a substantially planar lower support portion and an upper surface portion substantially parallel to said lower support portion, said upper surface portion being at the highest point of said mound body;

a pitching rubber positioned in said upper surface portion;

a first depression surrounding said pitching rubber and within said upper surface portion, said depression being filled with flowable soil-like material to the level of said upper surface portion said mound further having a forward facing shaped area adjacent said upper surface portion and a second depression in said forwardly facing sloped area filled with flowable soil-like material sloped to conform with said forwardly facing sloped area.

2. The portable pitcher's mound assembly of claim 1, wherein:

a home plate is attached to said forward sloped area by calibrated lines such that said mound body and said home plate are a fixed distance apart.

3. The portable pitcher's mound assembly of claim 1, wherein:

said pitching rubber includes markings thereon for proper foot location.

4. The portable pitcher's mound assembly of claim 1, wherein:

said flowable soil-like material in said first depression provides a footing area for the pitcher;

said flowable soil-like material in said second depression provides a landing area for the pitcher's feet after completion of the pitch delivery; and said flowable soil-like material provides field-like conditions on said mound body.

5. The portable pitcher's mound assembly of claim 1, wherein:

said mound body comprises molded fiberglass and said flowable soil-like material comprises sand.

6. The portable pitcher's mound assembly of claim 1, wherein:

said forward sloped area has markings thereon for foot location in said second depression.

7. The portable pitcher's mound assembly of claim 1, wherein:

said assembly is used indoors or outdoors for training purposes.

8. The portable pitcher's mound assembly of claim 1, wherein:

said first depression has sufficient depth to permit grooming of said flowable soil like material to an individuals preferences.

9. The portable pitcher's mound assembly of claim 1, wherein:

the upper surface of said mound body includes an abrasive surface for better footing.

10. The portable pitcher's mound assembly, comprising:

a generally circular, generally convex-shaped mound body to be supported on a playfield surface, said body having a substantially planar lower support surface portion on an upper surface portion substantially parallel to said lower surface portion, said upper surface portion being area at the highest point of said mound body;

a pitching rubber positioned in said upper surface portion;

a first depression surrounding said pitching rubber and within said upper surface portion, said depression filled with flowable soil-like material to the level of said upper surface portion;

said mound further having a forward facing sloped area adjacent said upper surface portion a second depression in said forwardly facing sloped area filled with flowable soil-like material sloped to conform with the said forwardly faced sloped area; and said mound body provided in a series of interlocking sections for easy transportation.

11. The portable pitcher's mound assembly of claim 10, wherein:

a home plate is attached to said forward sloped area by calibrated lines such that said mound body and said home plate are fixed distance apart.

12. The portable pitcher's mound assembly of claim 10, wherein:

said pitching rubber includes markings thereon for proper foot location.

13. The portable pitcher's mound assembly of claim 10, wherein:

said flowable soil-like material in said first depression provides a footing area for the pitcher;

said flowable soil-like material in said second depression provides a landing area for the pitcher's feet after completion of the pitch delivery; and said flowable soil-like material provides field-like conditions on said mound body.

14. The portable pitcher's mound assembly of claim 10, wherein:

said mound body comprises molded fiberglass and said flowable soil-like material comprises sand.

15. The portable pitcher's mound assembly of claim 10, wherein:

said forward sloped area has markings thereon for foot location in said second depression.

16. The portable pitcher's mound assembly of claim 10, wherein:

said assembly is used indoors or outdoors for training purposes.

17. The portable pitcher's mound assembly of claim 10, wherein:

said first depression has sufficient depth to permit grooming of said flowable soil-like material to an individuals preferences.

18. The portable pitcher's mound assembly of claim 10, wherein:

the upper surface of said mound body includes an abrasive surface for better footing.

* * * * *